US005614063A

United States Patent [19]

Graf et al.

[11] Patent Number: 5,614,063

[45] Date of Patent: Mar. 25, 1997

[54] INDUCTIVE EDGE DETECTOR FOR PAPER MACHINERY

[75] Inventors: Edwin X. Graf, Menasha; James A. Eng, Appleton, both of Wis.

[73] Assignee: Voith Sulzer Paper Technology North America, Inc., Appleton, Wis.

[21] Appl. No.: 531,549

[22] Filed: Sep. 18, 1995

[51] Int. Cl.[6] ..... D21F 7/06; D21F 7/08

[52] U.S. Cl. ..... 162/263; 162/252; 162/273; 242/413.3; 242/413.9; 226/45; 226/23; 73/514.31; 369/52

[58] Field of Search ..... 162/263, 252, 162/273, 198; 242/413.3, 413.9, 419.1, 422.2; 226/94, 45, 100, 77, 23, 28; 123/167; 73/514.31; 369/52; 340/551; 324/200

[56] References Cited

U.S. PATENT DOCUMENTS

| | | | |
|---|---|---|---|
| 3,079,805 | 4/1963 | Rojecki | 226/23 |
| 3,727,817 | 4/1973 | Tibavido | 226/45 |
| 3,974,766 | 8/1976 | Zimmer | 101/247 |
| 4,174,171 | 11/1979 | Hamaker et al. | 355/3 BE |
| 4,893,740 | 1/1990 | Dediger et al. | 226/23 |
| 4,947,685 | 8/1990 | Montgomery et al. | 73/159 |
| 5,109,193 | 4/1992 | Pike | 324/207 |
| 5,117,969 | 6/1992 | Roth | 198/807 |
| 5,328,072 | 7/1994 | Ruessmann et al. | 226/15 |
| 5,349,728 | 9/1994 | Murakami et al. | 28/107 |

*Primary Examiner*—Donald E. Czaja
*Assistant Examiner*—Jose A. Fortuna
*Attorney, Agent, or Firm*—Taylor & Associates, P.C.

[57] ABSTRACT

The invention is directed to a continuous belt edge detector system for use in a paper making machine having a continuous belt guide device. The edge detector system comprises a continuous belt having an edge dope with metallic particles therein and an inductive sensor connected to the guide device and adjacent the edge dope. The inductive sensor sends a signal to the guide device indicative of a location of the continuous belt. The guide device moves the continuous belt, e.g., transversely relative to the running direction of the belt within the machine, dependent on the inductive sensor signal.

13 Claims, 1 Drawing Sheet

INDUCTIVE EDGE DETECTOR FOR PAPER MACHINERY

BACKGROUND OF THE INVENTION

1. Field of the Invention.

The present invention relates to paper-making machines, and, more particularly, to edge detectors for guiding a continuous belt therein.

2. Description of the Related Art.

Prior paper-making machines include continuous belts such as those made of "forming fabric" or felt to conduct the paper web throughout the paper-making machine. These continuous belts run at high velocities and sometimes have a tendency to move transversely relative to the running direction of the belt, thereby causing the edge of the belt to roll up against, contact, and/or wear on an interior edge of the machine.

Prior sensing devices to monitor such undesirable motion include the use of a mechanical sensing device in the form of a steel paddle that is oriented along the side of the continuous belt, such that when the continuous belt rubs against the steel paddle, a signal is provided to a guide device indicative of the transverse position of the continuous belt. The guide device shifts or moves the continuous belt transversely back into its normal running position within the machine in a continuous manner. Normally such mechanisms include a guide roll to direct the continuous belt or forming fabric. A problem with such steel paddles is that the physical contact of rubbing with the high velocity moving belt causes grooves to form in the paddle over time, thereby inducing inaccuracies in the mechanical sensing device and wearing out the paddle. Additionally, the edges of the continuous belt may wear and fray with such contact.

Another type of edge sensing mechanism is that of an optical sensor. This type of sensor utilizes an optical pickup for determining the path or the location of the edge of the belt such that when the edge of the belt is in an undesirable location, a guide device is activated to move the continuous belt transversely back to its normal running position. A problem with optical sensors is that the optical pickup eyes must be clean to operate consistently. The paper-making environment normally has a large amount of particulate matter and fiber adjacent to optical edge sensors which tend to cause these optical sensors to signal falsely or not operate at all. Because of this problem, mechanical sensing devices are still used as a backup sensing mechanism. Additionally, such optical sensors are expensive.

What is needed in the art is a relatively inexpensive edge detector system able to withstand the paper-making environment.

SUMMARY OF THE INVENTION

The present invention provides a continuous belt edge detector system for use with a continuous belt of a paper-making machine. The continuous belt includes an edge having an edge dope with metallic particles therein. An inductive sensor is connected to the guide device and disposed near the edge dope. The inductive sensor sends a signal to the guide device indicative of the location of the continuous belt to cause the guide device to move the continuous belt transversely back to a normal running position.

The invention comprises, in one form thereof, a continuous belt edge detector system for use with a paper making machine having a continuous belt guide device. The system comprises a continuous belt having an edge, the edge including an edge dope with metallic particles therein, with the continuous belt having a running direction in the machine. An inductive sensor is connected to the guide device, adjacent the edge dope, and sends a signal to the guide device indicative of a location of the continuous belt with the guide device moving the continuous belt transversely relative to the running direction dependent on the inductive sensor signal.

An advantage of the present invention is that no mechanical engagement is necessary with the rapidly moving continuous belt; therefore no wear of the edge detector system or the continuous belt occurs. Further, there is no paddle or limit switch to wear out.

Another advantage of the present invention is that particulate matter or fiber in the paper-making environment does not affect the inductive sensor, thereby preventing false sensing of an out of normal belt edge location.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
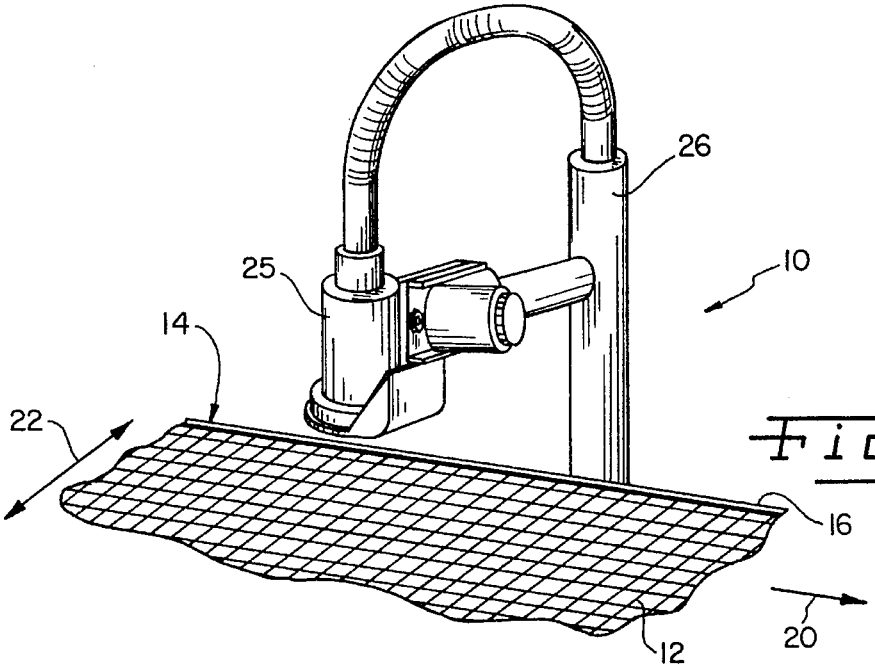
FIG. 1 is a fragmentary perspective view of an embodiment of an edge detector system of the present invention.

Referring now to the drawings and particularly to FIG. 1, there is shown an edge detector system 10 of the present invention, including a continuous belt 12 and holding bracket 26

Continuous belt 12 has an outer edge 14 on at least one side thereof, only one of which is shown in the drawings. Edge 14 includes a particular type of edge dope 16 to be discussed below. Continuous belt 12 has a running direction as shown by directional arrow 20 and is moveable in a transverse direction as shown by directional arrow 22. In the embodiment shown, continuous belt 12 is in the form of a forming fabric made from a polyester fiber mesh. However, continuous belt 12 could be that of a felt or impermeable belt.

Edge detector system 10 includes a plurality of inductive sensors 24 disposed within a sensor head 25 and connected to a holding bracket 26. Inductive sensors 24 are oriented operationally adjacent edge 14 of continuous belt 12. A guide device 18, as known in the art, is shown schematically in FIG. 2 and is operatively associated with the plurality of inductive sensors 24.

Figure 3:
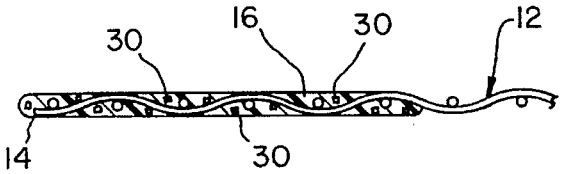
FIG. 3 is an enlarged, cross-sectional view of the continuous belt having an edge dope.

Edge dope 16 of the present invention is formed of a polymeric matrix such as that formed by adding powdered metal to a flexible, i.e., non-brittle, epoxy or polyester. As shown more specifically in FIG. 3, edge dope 16 is formed about edge 14 and includes a plurality of metal or metallic particles 30 disposed therein. Metallic particles 30 are in the form of magnetically non-permeable particles. "Magnetically non-permeable", as used in this application, means particles which are magnetic or capable of being magnetic in the presence of an inductive field.

An example of metallic particles 30 which may be used in the present invention is 410 stainless steel in a powdered metal form. Alternatively, other types of ferrous metal or composites may be equivalently utilized. These metallic particles 30 and edge dope 16 serve to provide a target for inductive sensors 24, while additionally holding or sealing the cut edges of continuous belt 12 to thereby prevent fraying of continuous belt 12. Instead of the powdered metal particles 30 disposed in edge dope 16, fiber metal flakes or whiskers could also be disposed within edge dope 16 to create a better inductance effect. Other equivalent structures to create an inductive band about edge 14 include a metallized mylar ribbon which is woven into an edge area 14 of continuous belt 12, a metallic ribbon immersed in edge dope 16, or metal staples inserted through edge dope 16. Additionally, pieces of metal foil could be used within edge dope 16 instead of powdered metal particles 30. Thus, in general, the structure to be created is a metallic target suitable for activating inductive sensors 24.

Figure 2:
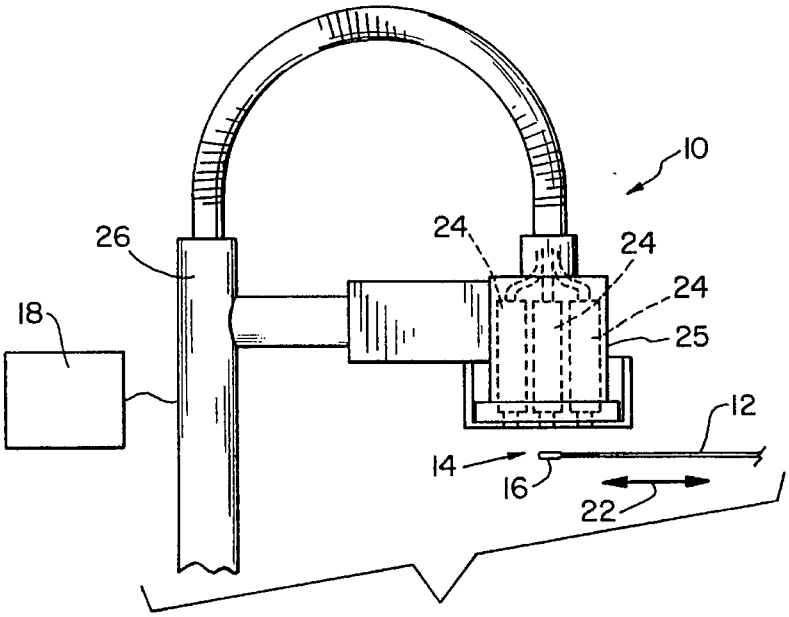
FIG. 2 is a schematical, side view of the embodiment shown in FIG. 1.

As shown more clearly in FIG. 2, the position of edge 14 is determined by the output of one or more signals from the plurality of inductive sensors 24, dependent on the location of sensors 24 relative to edge dope 16 with metallic particles 30 therein. The signals developed by sensors 24 cause guide device 18 to move belt. More particularly, each sensor 24 provides a signal to guide device 18, which in turn is adapted to move continuous belt 12 in transverse direction 22, if needed. Depending upon the distance between edge dope 16 and sensors 24, inductive sensors 24 provide differing and continually varying output signals to guide device 18. By comparing the signals provided by each of conductive sensors 24, it is possible to determine the position as well as the transverse direction of travel of continuous belt 12.

Additionally, it is also possible to utilize two inductive sensors 24, rather than three inductive sensors as shown in the drawings. More particularly, it will be appreciated that if two inductive sensors are utilized, the output signals from each inductive sensor are about the same if the edge dope is disposed equidistantly between the two sensors. On the other hand, if the edge dope is moving away from each sensor (such as by traveling in a transverse direction), the magnetic flux for each sensor decreases with respect to time. However, the sensor closest to the edge dope provides a stronger signal than the sensor disposed furthest from the edge dope. It is thus possible to determine the direction of travel using two sensors.

Figure 4:
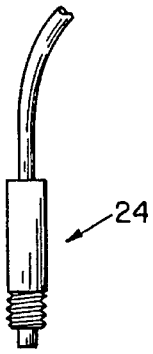
FIG. 4 is an elevational view of an inductive sensor utilized in the present invention.

In operation, a drive mechanism (not shown) causes continuous belt 12 to move in a running direction 20. During the paper-making operation, at times, continuous belt 12 becomes transversely mobile, moving in a transverse direction 22. As shown more clearly in FIG. 2, transverse movement of belt 12 with edge dope 16 containing metallic particles causes a change in position relative to sensors 24. This change in position will change the inductive measurement determined by sensors 24 and thereby change the output (signal) of inductive sensors 24 and subsequently cause a change in input state to guide device 18. Guide device 18 utilizes the signals which are input from inductive sensors 24 and thereby causes continuous belt 12 to move in a transverse direction back into a preferred orientation, usually centered in the paper-making machine. One particular type of inductive sensor 24 is a 7200 Series Proximity Transducer which is available from Bently Nevada Company of Minden, Nev., U.S.A. That type of available inductive sensor 24 is shown in FIG. 4.

Figure 5:
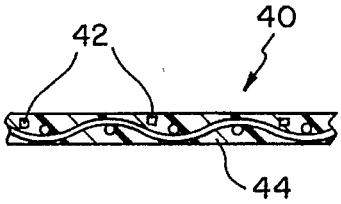
FIG. 5 is a fragmentary side view of another embodiment of a continuous belt having an edge dope.

Referring now to FIG. 5, another aspect of the present invention is not only that of determining the location of edge 14, but also determining the running speed of continuous belt 40 in the running direction 20 (FIG. 1). This is accomplished by spacing the metallic particles or fibers 42 in edge dope 44 a predetermined distance apart in the running direction indicated by arrow 20. As belt 40 moves in running direction 20, inductive sensors 24 are activated by the discreetly and evenly spaced moving particles 42. Based upon the frequency of the pulses and the known spacing between the metallic portions, calculations may be made to determine the speed of continuous belt 40 dependent on the pulse rate and the separation distance.

In the embodiment shown and described above, a plurality of inductive sensors 24 are used to determine the position and direction of travel of edge dope 16. However, it is also to be understood that it is also possible to use a Hall device to determine the position and the direction of travel of edge dope 16.

A further aspect of the invention is the ability to determine stretch of the continuous belt under loading conditions at various points along the continuous belt. Particularly, as indicated above, particles 42 may be equidistantly spaced within edge dope 16 with respect to running direction 20. Particles 42 are placed within edge dope 16 under a no-load condition at a predetermined, equidistant spacing. When continuous belt 12 is stretched during use, it will be appreciated that the distance between particles 42 also increases in proportion to the amount of stretch in continuous belt 12. Using the known speed of travel of continuous belt 12, and the time duration between pulses at a particular location along continuous belt 12, it is also possible to determine the amount of stretch of continuous belt 12. That is, the distance between particles 42 increases as continuous belt 12 is stretched and the corresponding time duration between sensed pulses also increases corresponding to the amount of stretch.

In the event that equidistantly spaced particles are used to determine the stretch of continuous belt 12, guide device 18 includes software or hardware enabling the appropriate calculations to be carried out to establish the stretch of continuous belt 12. In the event that software is utilized, guide device 18 may be easily programmed to carry out the necessary calculations. The determined stretch may be in the form of elastic stretch caused by excessive local loading on continuous belt 12, or permanent stretch caused by wear of continuous belt 12.

Further, it may also be possible to determine stretch of continuous belt 12 using colored patterns disposed in or on edge dope 16 at equidistant spacings with respect to running direction 20. In such event, optical sensors are used instead of inductive sensors. As described above, the known spacing between colored patterns, the known running speed of continuous belt 12, and the pulse rate sensed by an optical sensor can be used to determine stretch of continuous belt 12 at a particular location.

If particles 42 are equidistantly spaced and used to determine the stretch in continuous belt 12 under load conditions, it is only necessary to use the pulse rate sensed by one of inductive sensors 24, as the pulse rates sensed by the remaining inductive sensors 24 are about the same.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper making machine having a continuous belt guide device, a continuous belt edge detector system comprising:

a continuous belt having an edge, said edge including an edge dope with metallic particles therein, said continuous belt having a running direction in the machine; and an inductive sensor connected to the guide device and adjacent said edge dope, said inductive sensor sending a signal to the guide device indicative of a location of said continuous belt, the guide device moving said continuous belt transversely relative to said running direction dependent on said inductive sensor signal.

2. The edge detector system of claim 1, wherein said edge dope comprises a polymeric resin filled with metal filings.

3. The edge detector system of claim 1, wherein said continuous belt comprises a polymeric mesh.

4. The edge detector system of claim 1, wherein said metallic particles are spaced a predetermined distance from each other along the running direction of said continuous belt.

5. The edge detector system of claim 4, wherein said metallic particles are equidistantly spaced from each other.

6. The edge detector system of claim 1, wherein said inductive sensor comprises one of a plurality of inductive sensors, each said inductive sensor connected to the guide device and adjacent said edge dope, each said inductive sensor sending a signal to the guide device indicative of said location of said continuous belt.

7. A paper making machine including at least one of a wet end, a press section and a drying section, said paper making machine comprising:

a continuous belt having an edge, said edge including an edge dope with metallic particles therein, said continuous belt having a running direction in the machine;

a guide device to move said continuous belt transversely relative to said running direction; and an inductive sensor connected to said guide device and adjacent said edge dope, said inductive sensor sending a signal to said guide device indicative of a location of said continuous belt, said guide device moving said continuous belt transversely relative to said running direction dependent on said inductive sensor signal.

8. The edge detector system of claim 7, wherein said edge dope comprises a polymeric resin filled with metal filings.

9. The edge detector system of claim 7, wherein said continuous belt comprises a polymeric mesh.

10. The edge detector system of claim 7, wherein said metallic particles are spaced a predetermined distance from each other along the running direction of said continuous belt.

11. The edge detector system of claim 10, wherein said metallic particles are equidistantly spaced from each other.

12. The edge detector system of claim 7, wherein said inductive sensor comprises one of a plurality of inductive sensors, each said inductive sensor connected to the guide device and adjacent said edge dope, each said inductive sensor sending a signal to the guide device indicative of said location of said continuous belt.

13. A continuous belt in combination with a paper making machine, said continuous belt adapted for one of carrying and contacting a fiber web, said continuous belt having an edge, said edge including an edge dope with magnetically non-permeable particles therein.

* * * * *